US008176856B2

(12) United States Patent
Dickner

(10) Patent No.: US 8,176,856 B2
(45) Date of Patent: May 15, 2012

(54) LOADING LEDGE

(75) Inventor: Allan Dickner, Älmhult (SE)

(73) Assignee: Inter Ikea Systems B.V., Delft (NL)

( * ) Notice: Subject to any disclaimer, the term of this patent is extended or adjusted under 35 U.S.C. 154(b) by 0 days.

(21) Appl. No.: 12/886,101

(22) Filed: Sep. 20, 2010

(65) Prior Publication Data

US 2011/0005434 A1 Jan. 13, 2011

Related U.S. Application Data

(63) Continuation of application No. 11/083,533, filed on Mar. 18, 2005, now abandoned, which is a continuation of application No. PCT/SE03/01437, filed on Sep. 15, 2003.

(51) Int. Cl.
*B65D 19/44* (2006.01)

(52) U.S. Cl. ..... 108/55.5; 108/51.11

(58) Field of Classification Search ..... 108/51.11, 108/55.1, 55.3, 55.5, 57.16, 57.17, 57.2, 108/56.3, 51.3, 901, 902, 53.3; 206/597, 206/386, 595, 599, 598, 596; 24/168, 170, 24/173, 191; 224/42.39, 42.33; 248/346.03
See application file for complete search history.

(56) References Cited

U.S. PATENT DOCUMENTS

| | | | |
|---|---|---|---|
| 1,617,768 | A | 2/1927 | Ruff |
| 1,690,873 | A | 11/1928 | O'Neil |
| 2,611,569 | A | 9/1952 | Coleman et al. |
| 2,685,398 | A | 8/1954 | King |
| 3,347,185 | A | 10/1967 | Colas |
| 3,353,697 | A | 11/1967 | Martin et al. |
| 3,390,765 | A | 7/1968 | Grant |
| 3,472,363 | A | 10/1969 | Overton et al. |
| 3,675,595 | A | 7/1972 | Sullivan |
| 3,753,407 | A | 8/1973 | Tilseth |
| 3,880,286 | A | 4/1975 | Wegener |
| 3,910,202 | A | 10/1975 | Skahan |
| 4,065,014 | A | 12/1977 | Sagmiller |
| 4,148,394 | A | 4/1979 | Bederman |
| 4,509,433 | A | 4/1985 | Farr |
| 4,735,154 | A | 4/1988 | Hemery |
| 4,886,694 | A | 12/1989 | Donnard |
| 5,344,277 | A | 9/1994 | Sandland |
| 5,355,813 | A | 10/1994 | Darnell et al. |
| 5,423,428 | A | 6/1995 | Selz |
| 5,528,995 | A | 6/1996 | Lim |
| 5,549,341 | A | 8/1996 | Chase et al. |
| 5,720,229 | A | 2/1998 | Schrage |
| 5,813,536 | A | 9/1998 | Bartholomew |
| 5,931,435 | A | 8/1999 | Hoadley et al. |

(Continued)

FOREIGN PATENT DOCUMENTS

| | | |
|---|---|---|
| DE | 4236620 | 5/1994 |
| JP | 55-131923 | 9/1980 |
| JP | 55-156030 | 11/1980 |

(Continued)

*Primary Examiner* — Jose V Chen
(74) *Attorney, Agent, or Firm* — Merchant & Gould P.C.

(57) ABSTRACT

A loading ledge to be used in transport and storing and a system for creation of load units. The loading ledge has an upper leg and a lower leg forming a substantially L-shaped cross section. The lower leg is furnished with one or more projections to make it possible to use handling equipment. One or more locking units are integrated in the loading ledge to grip straps or the like. The load unit is created in that two or more loading ledges are used together with straps to fixate the goods on the loading ledges.

13 Claims, 4 Drawing Sheets

U.S. PATENT DOCUMENTS

| | | | |
|---|---|---|---|
| 5,960,958 | A | 10/1999 | Michaud et al. |
| 6,305,566 | B1 | 10/2001 | Pigott et al. |
| 6,485,252 | B1 | 11/2002 | Heil |
| 6,510,592 | B1 | 1/2003 | Hamilton |
| 6,883,666 | B1 | 4/2005 | Wang |
| 6,941,877 | B2 | 9/2005 | Dickner |
| D551,424 | S | 9/2007 | Meisen et al. |

FOREIGN PATENT DOCUMENTS

| | | |
|---|---|---|
| JP | 6-1236 | 1/1994 |
| JP | 7-40453 | 7/1995 |
| JP | 11208658 | 8/1999 |
| JP | 2000-197236 | 7/2000 |
| WO | WO 01/76959 | 10/2001 |
| WO | WO 0212076 | 2/2002 |
| WO | WO 02/38471 | 5/2002 |

LOADING LEDGE

This application is Continuation of U.S. Ser. No. 11/083,533, filed 18 Mar. 2005, which is a Continuation Application of PCT/SE2003/001437, filed 15 Sep. 2003, which claims benefit of Ser. No. 0202779-5, filed 18 Sep. 2002 in Sweden and which applications are incorporated herein by reference. To the extent appropriate, a claim of priority is made to each of the above disclosed applications.

TECHNICAL FIELD

The present invention concerns an improved loading ledge to be used e.g. in transport and storing and a system for creation of load units.

PRIOR ART

For transport and storage of different types of goods it is today common to use pallets. Normally wooden pallets of standardized dimensions are used. Often straps and/or stretch or shrink wrapping are wrapped around the pallet including the goods.

Other means for transportation and storage are known, e.g. loading ledges to be placed at the goods. One or more articles are placed on two or more loading ledges to form a unit load. Each loading ledge comprising an L-shaped profile having projections for supporting the unit load at a certain distance over its support. The loading ledges are positioned at a lower edge of the unit load for storage and/or transport of the unit load including its loading ledges to a receiver of the articles. The unit loads are formed, by strapping the loading ledges and the goods. The straps have to be locked with clips or the like to securely hold the goods at the loading ledges.

By the provision of the supporting projections on the loading ledges the formed unit load can be handled by handling equipment, such as forklift trucks or pallet trucks, used for handling unit loads on wooden pallets.

The loading ledges are preferably produced of recyclable plastic, for example uncoloured polypropylene (PP). The production method may be injection moulding. Other materials and production techniques are possible.

The loading ledges may be returned for renewed use on new unit loads, but it may be advantageous to recycle them, for example by grinding them, and to return the material to a producer of loading ledges. Alternatively, the material can be put on the ordinary market as plastic raw material. In the latter case it is of special importance to have the plastic material uncoloured.

With the use of loading ledges as set out above it will be possible to use one size only for all applications. The size of the unit load is not dependent on any pallet size but rather on the size of the articles, provided at their bottom edges with two or more loading ledges with downwardly extending projections allowing handling by traditional handling equipment. If the articles are long, two or even three loading ledges may be provided at each lower edge.

The use of loading ledges means in other words that an optimal unit load may be built according to the goods or articles, not according to the pallet size as today.

Further, the tara weight and the price for the loading ledge are very low.

Empty loading ledges may be stacked for transportation, which thus may be very effective.

As stated above straps are normally used to hold the goods. Said straps are to be locked with clips or the like. Even if existing clips function well in many respects, they are loose, discrete elements, which should be at hand when needed. Furthermore, it is a risk that the prior art clips or other locking means for the straps harm goods placed on adjacent pallets, as the locking means normally are placed in varying positions. Depending on the goods such damages may be serious.

SUMMARY OF THE INVENTION

When designing new products there are a number of more or less obvious objects. Such objects are e.g. having as low weight as possible, in order to reduce the amount of material used and, thus, to save costs. It is also a general object to be able to produce the products in a simple and reliable way to reduce costs.

One specific object with the present invention is that the loading ledge should be easy to use. A further object is that the loading ledges should be possible to stack, in order to facilitate transport and storing.

Yet an object is that then loading ledge should be environmental friendly.

According to the present invention a loading ledge having an upper leg and a lower leg forming a substantially L-shaped cross section is formed. The lower leg of the loading ledge is furnished with one or more projections. One or more locking means are integrated in the loading ledge.

By using loading ledges according to the present invention for creation of unit loads instead of pallets of a standard dimension the goods it is normally possible to store the goods more compactly. When using standard pallets the total available loading areas are often not used, unless the size of each item of the goods is adapted to the size of the pallets. Furthermore, the loading ledges of the present invention are lower than most standard pallets, increasing the possibility to fully use the available space in containers, trucks, lorries, warehouses etc. Loading ledges according to the present invention are automatically adapted to the dimensions of the unit loads.

The weight of the loading ledges are kept as low as possible by providing it with a number of openings, without jeopardising the function. The low weight is beneficial both concerning transport and in that less material is needed to produce each loading ledge.

Further objects and advantages of the present invention will become obvious for a person skilled in the art when reading the detailed description below of preferred embodiments.

BRIEF DESCRIPTION OF THE DRAWINGS

The invention will be described more closely below by way of an example and with reference to the enclosed drawings. In the drawings.

DETAILED DESCRIPTION OF PREFERRED EMBODIMENTS

Figure 1:
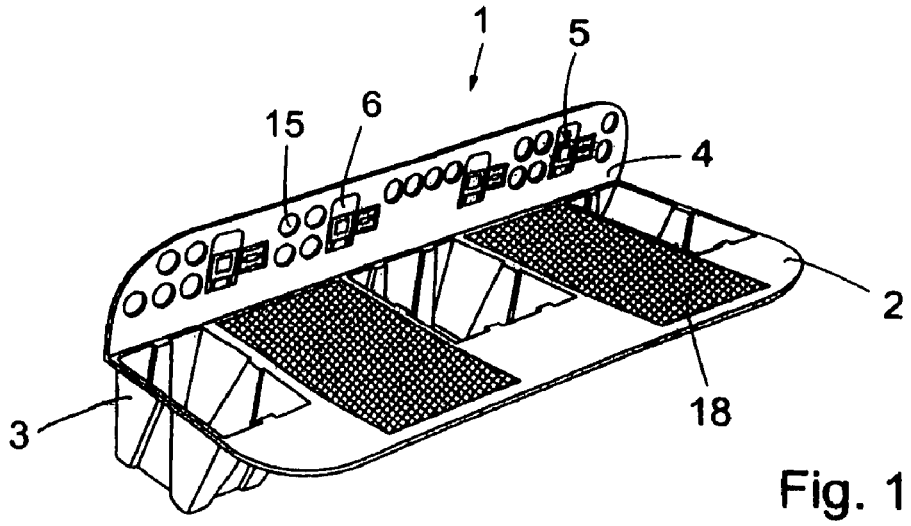
FIG. 1 is a perspective view of a loading ledge according to the present invention.
Figure 2:
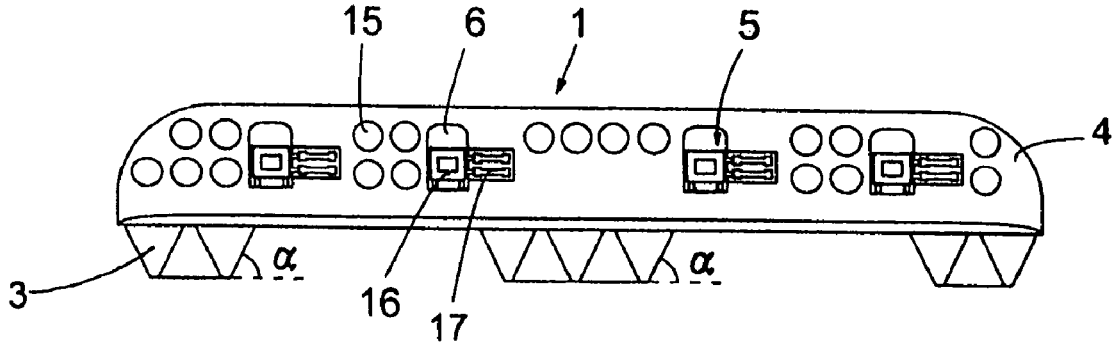
FIG. 2 is a front view of the loading ledge of FIG. 1.
Figure 3:
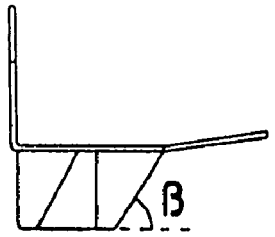
FIG. 3 is an end view of the loading ledge of previous FIGS.

As used in this description the expressions "upper", "lower" etc. are with reference to loading ledges 1 as shown in the FIGS.

The present invention concerns loading ledges 1 to be used in transport and storing of goods 19. The loading ledges 1 comprises a lower leg 2 and an upper leg 4, which legs 2, 4 are arranged almost perpendicular to each other. Thus, the loading ledge 1 will have a substantially L-shaped cross section. The loading ledge 1 is preferably an injection moulded, L-shaped profile of recyclable plastic, preferably polypropylene (PP). Its lower leg 2 is provided with projections 3, in the shown case three projections, for supporting a unit load above the ground or other support. The projections 3 make it possible to handle the unit load with ordinary handling equipment utilised for goods on ordinary wooden pallets presently widely used in distribution systems. The upper leg 4 of the loading ledge 1 is generally plain and is to bear against a vertical side surface of a unit load to be supported by the loading ledges. At least the free or outer end of the lower leg 2, i.e. the part outside the projections, is slightly inclined upwards. By slightly inclined as used here is meant a few degrees or even parts of degree.

The upper leg 4 and lower leg 2 of the loading ledge 1 are slightly inclined towards each other. Thereby, and by the fact that the outer end of the lower leg 2 inclines slightly upwards the loading ledge 1 will be held snugly against the goods in use.

As used in this description the term "unit load" includes the loading ledges 1, the goods 19 received on two or more loading ledges 1 and stretching devices, such as straps 14.

In the upper leg 4 a number of locking means or clips 5 are arranged. The clips 5 are arranged in openings 6 of the upper leg 4. The openings 6 are to receive the straps 14. The clips 5 are integrated parts of the upper leg 4 and are each formed of a frame 16 and two foldable parts 17. The foldable parts 17 are in one embodiment releasably fixed to the frame 16 by means of weakenings, which are easy to break by hand. In other embodiments the ends of the foldable parts 17 remote from the frame 16 are totally free, i.e. not fixed to the loading ledge 1. By means of the foldable parts 17 the straps 14 may be locked. In use the foldable parts are folded at the transition between each foldable part 17 and the associated frame 16. In the shown embodiment there are four clips 5 and openings 6. A person skilled in the art realises that other number of clips 5 and openings 6 may be used. Furthermore, a person skilled in the art realises that the clips as shown are only one example. The exact design of the clips 5 may vary as long as they fulfil the intended use.

A number of further, weight-reducing openings 15 are normally furnished in the loading ledge 1. Said further openings 15 are made mainly to save weight and to reduce the amount of material used. These weight-reducing openings 15 are placed to not impair the strength of the loading ledge 1 at normal use. The openings 15 are normally placed in the upper leg 4 of the loading ledge 1. However, a person skilled in the art realises that the weight-reducing openings 15 may be placed anywhere as long as they do not jeopardise the function of the loading ledge 1. Furthermore, the number and size of the weight-reducing openings 15 may vary. In one loading ledge openings of different sizes may be arranged.

The projections 3 have inclined sides to assist in stacking of a number of loading ledges 1 in each other. The side of each projection 3 placed more or less in line with the upper leg 4 of the loading ledge 2 has normally no inclination. The sides of each projection 3 facing the adjacent projections 3 and the short ends of the loading ledges 1 have an inclination of an angle $\alpha$ in relation to the horizontal plane. The angle $\alpha$ is normally between 50° and 70°, preferably between 60° and 70° and is most preferably 66.4°. The side of each projection 3 facing forward, i.e. closest to the outer end of the lower leg 2, has an inclination of an angle $\beta$ in relation to the horizontal plane. The angle $\beta$ is normally between 40° and 60°, preferably between 45° and 55° and most preferably 52°. The dimension of the projection 3 placed in the middle is normally somewhat larger than the dimensions of the other projections 3.

To enhance the friction the bottom of the projections 3 may have a number of small irregularities. The areas of small irregularities are referred to as friction patterns in this description. Also on the upper side of the lower leg 2 friction patterns 18 are provided. These friction patterns 18 are to assist in holding the goods more safely on the loading ledges 1. A person skilled in the art realises that the exact form and position of the friction patterns 18 may vary. Also the form of the irregularities of the friction patterns 18 may vary.

In a practical (but non-limiting) case the overall length of the loading ledge 1 is about 759 mm, the widths of the lower leg 2 and the upper leg 4 is about 179 mm and about 100 mm, respectively. The projections 3 have a height of about 45 mm and a width of about 50 mm at the bottom. The central projection has a length of about 120 mm at the bottom, and each of the two outer projections have a length of about 50 mm at the bottom. The size of the contact areas formed by the bottom areas of the projections 3 is important in order to have enough friction against the support. Due to the dimensions and angles of the projections the distance between adjacent loading ledges 1 when stacked is about 3 mm. This means that the loading ledges 1, when not in use, may be stacked in an easy and space-saving manner, which is beneficial for storage and possible transport of the loading ledges 1.

The height of the projections 3 and the distance between the projections 3 are adapted to the handling equipment used. Such handling equipment includes forklift trucks, pallet trucks etc. The distance between the projections 3 is chosen to allow for normal adjustment of the distance between the forks. Thus, the forks will normally not harm the projections 3.

The loading ledges 1 of the present invention are developed for handling equipment having relatively thin forks. The distance from the ground or other support to the bottom of the lower leg 2 is about 45 mm. Much of the handling equipment on the market today has a smallest distance between the support and the upper side of the forks of about 85 mm. Thus, such handling equipment cannot be used with standard loading ledges 1. To make it possible to use this type of handling equipment adapters 7, 12 have been developed for placement on the projections 3. Said adapters 7, 12 give a total distance from the ground or other support to the bottom of the lower leg 2 of about 90 mm. A person skilled in the art realises that by the use of adapters 7, 12 any suitable distance may be formed if needed due to the dimensions of the handling equipment used.

Figure 5:
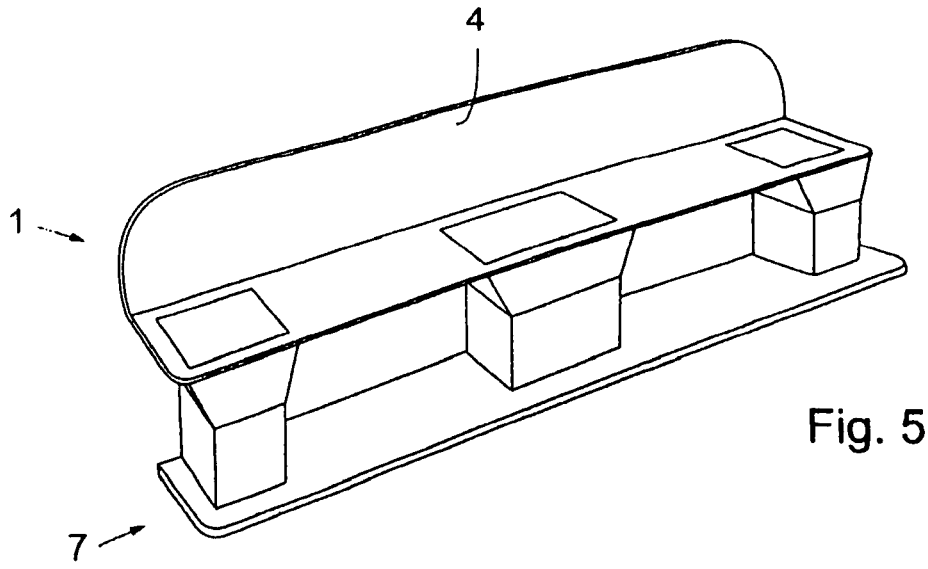
FIG. 5 is a perspective view of a loading ledge according to the invention furnished with an adapter.
Figure 6:
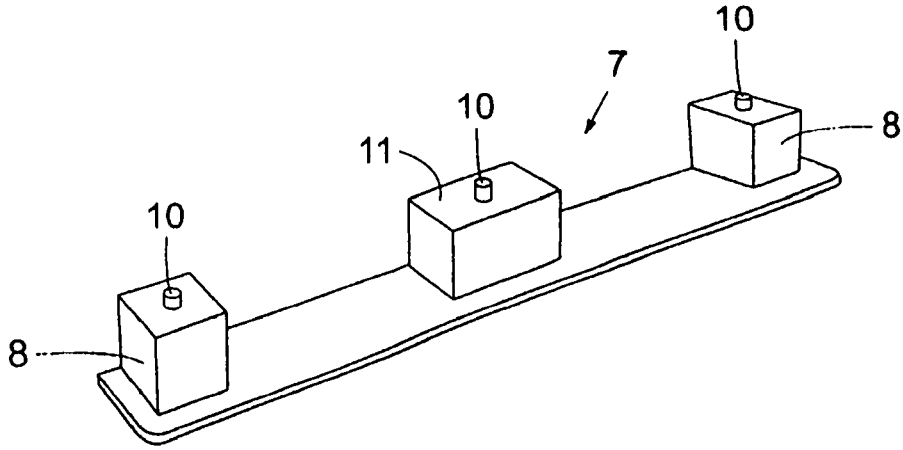
FIG. 6 is a perspective view of an adapter set used in the embodiment of FIG. 5.
Figure 7:
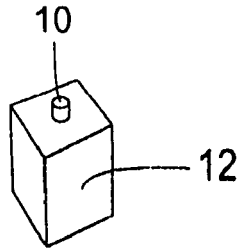
FIG. 7 is a perspective view of an alternative adapter to be attached to the loading ledge of FIGS. 1 to 3.
Figure 8:
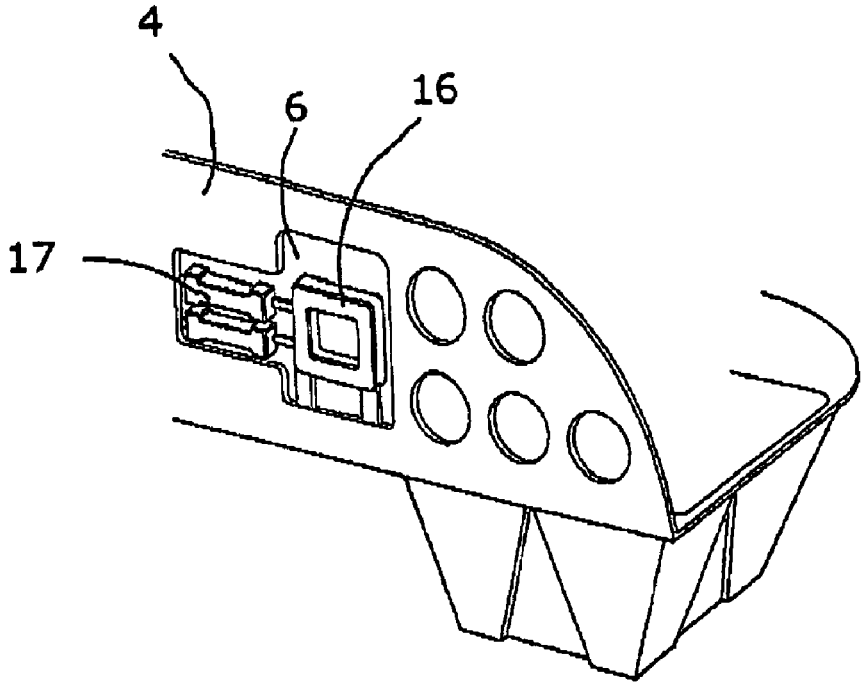
Figure 9:
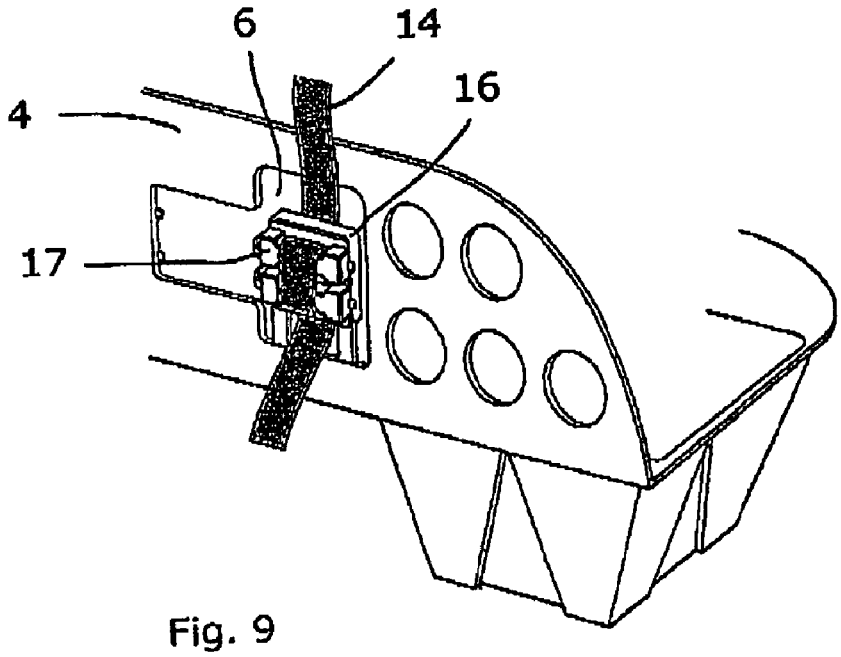

In a first embodiment, indicated in FIGS. 5 and 6 an adapter set 7 is formed. The adapter set 7 comprises a board 9 and three adapters 8, 11. Normally the board 9 and adapters 8, 11 are integrally formed. The adapters 8, 11 as shown have different sizes adapted to the sizes of the projections 3. On top of each adapter 8, 11 a peg 10 is formed. The purpose of the peg 10 is that it should be received in an opening in the bottom of corresponding projection 3. The connection between the peg 10 and opening of the projection is preferably of the type having a snapping effect. To reach said snapping effect the peg 10 may be furnished with a groove, receiving the edge of the opening of the projection 3. A person skilled in the art realises that the connection between peg 10 and opening may be accomplished in many different ways. Thus, it is possible to have a press fit between the peg 10 and the opening, in which case no groove is needed on the peg 10.

As indicated in FIG. 6 the adapters 12 may also be discrete elements for placement on each projection 3. Also these discrete adapters 12 have pegs 10 to be received in an opening of the projection 3 in the same way as stated above, regarding the adapter set 7. Normally, the size of each adapter 12 is adapted to the size of the projection 3' on which it is to be placed. However, it is also possible to have adapters 12 of only one size, irrespectively of the size of the projections 3. In this latter case the size of the adapters 12 is adapted to the size of the smallest projection 3.

Normally when not in use the loading ledges 3 and adapters 7, 10 are stored separately, i.e. not with the adapters 7, 10 attached to the loading ledges 1.

Figure 4:
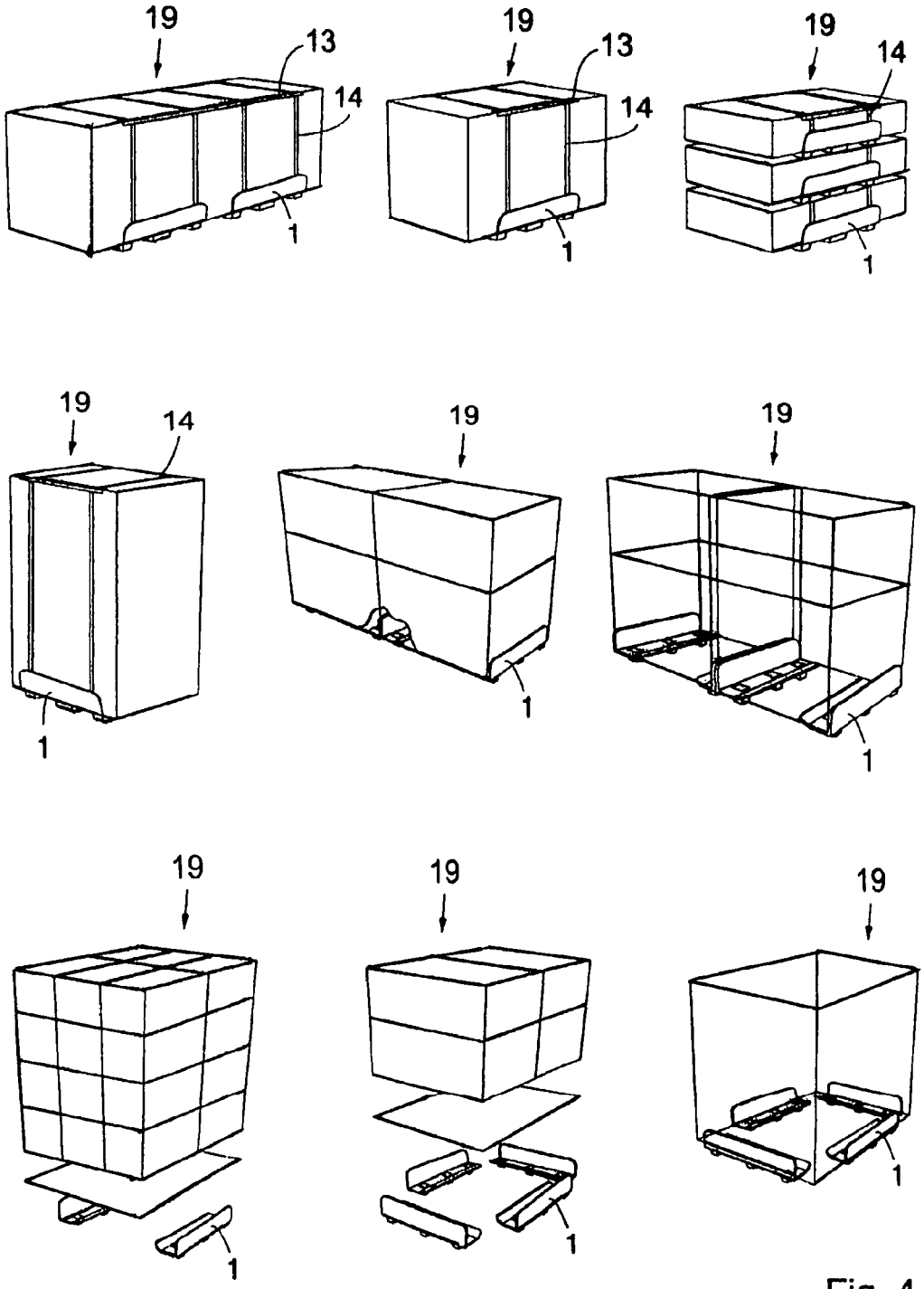
FIG. 4 shows different examples of unit loads formed using the loading ledges of FIGS. 1 to 3.

In use at least two loading ledges 1 are placed at the bottom of the goods 19. The two loading ledges 1 are placed at opposite sides of the goods 19. Different types of load units formed by means of the loading ledges 1 are indicated in FIG. 4. The straps 14 are drawn through both the openings 6 adjacent the clips 5 and the frames 6 of the clips 5 in the upper leg 4. As is normal for this type of clips 5 the grip will become more firm the more the strap 14 is pulled.

Normally some kind of edge protection 13 is placed under the strap 14 at the edges of the goods 19. This is especially important if the goods 19 are one or more cardboard boxes or the like susceptible to damage by the strap 14, as the strap 14 is tightened. It is also possible to integrate clips 5 or other locking means in each edge protection 13. The form and function of the clips 5 in the edge protection 13 is the same as for the clips 5 integrated in the loading ledges 1. A person skilled in the art realises that also edge protections 13 having no clips or other locking means for the straps may be used.

As indicated above it is quite common with existing clips that the clips harm goods on adjacent pallets during transport or storage. The clips are normally placed randomly, which means that they may adhere directly on goods on adjacent pallets. If the goods are cardboard boxes they are susceptible to damages. However, by using loading ledges 1 with integrated clips 5 according to the present invention, the clips 5 will be positioned aligned with clips 5 on adjacent unit loads. Thus, the contact between adjacent unit loads will be at the clips 5. Thereby the risk of harming the goods during transport or storage is reduced.

The invention claimed is:

1. A loading ledge comprising:

(a) an upper leg and a lower leg forming a substantially L-shaped cross-section;

(i) the upper leg having one or more openings;

(b) one or more projections extending from the lower leg in a downward direction away from the upper leg, the projections being constructed and arranged to be placed on a floor or other support;

(c) one or more clips arranged in the openings of the upper leg; each of the clips having a frame, two foldable parts, and a transition, said transition formed between each foldable part and the frame;

(i) the frame being within one of the openings in the upper leg and fixed to the upper leg;

(ii) the two foldable parts having one end fixed to the frame and another end releasably fixed to the upper leg; and (iii) the two foldable parts being foldable at the transition relative to the respective frame.

2. The loading ledge of claim 1,wherein the ends of the foldable parts remote from the frame are releasably fixed to the loading ledges.

3. The loading ledge of claim 1, wherein four clips are arranged in each loading ledge.

4. The loading ledge of claim 1 wherein the lower and upper legs are slightly inclined towards each other.

5. The loading ledge of claim 1, wherein each projection has four sides, one side approximately in line with the upper leg of the loading ledge, two sides facing short ends of the loading ledges and one side facing forward, wherein at least three of the sides of the projections are inclined to assist in stacking of a number of loading ledges in each other.

6. The loading ledge of claim 1, wherein an adapter set is placed on several projections, which adapter set comprises a board and two or more adapters.

7. The loading ledge of claim 6, wherein each adapter is furnished with means for a fixed connection with an opening of each projection.

8. The loading ledge of claim 7, wherein the means for fixed connection of the adapter is a peg.

9. The loading ledge of claim 1, wherein one discrete adapter is placed on each projection.

10. The loading ledge of claim 1, wherein the loading ledge has a length of about 759 mm, the upper leg has a height of about 100 mm, the lower leg has a width of about 150 mm, and each projection has a height of about 45 mm.

11. The loading ledge of claim 1, wherein three projections are arranged at the loading ledge, of which one of the projections is placed in between the other two projections and has a larger bottom area than the other two projections.

12. The loading ledge of claim 1, wherein the loading ledge is furnished with weight-reducing openings.

13. The loading ledge of claim 12, wherein the weight reducing openings are placed of the loading ledge.

* * * * *